US007111619B2

(12) United States Patent
Schneider

(10) Patent No.: US 7,111,619 B2
(45) Date of Patent: Sep. 26, 2006

(54) MAGNETIC FIELD PROTECTION FOR THE PROJECTILE OF AN ELECTROMAGNETIC COIL GUN SYSTEM

(75) Inventor: Arthur J. Schneider, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/758,437

(22) Filed: Jan. 15, 2004

(65) Prior Publication Data

US 2006/0027084 A1 Feb. 9, 2006

(51) Int. Cl.
*F41B 6/00* (2006.01)

(52) U.S. Cl. ..... 124/8

(58) Field of Classification Search ..... 89/8; 124/3; 310/12; 318/38

See application file for complete search history.

(56) References Cited

U.S. PATENT DOCUMENTS

| | | | | |
|---|---|---|---|---|
| 2,235,201 | A | 3/1941 | Cole | |
| 3,611,783 | A | 10/1971 | Mittelmann | |
| 4,791,850 | A * | 12/1988 | Minovitch | 89/8 |
| 4,926,741 | A | 5/1990 | Zabar | |
| 5,024,137 | A * | 6/1991 | Schroeder | 89/8 |
| 5,093,313 | A * | 3/1992 | Minovitch | 505/164 |
| 5,125,321 | A | 6/1992 | Cowan, Jr. et al. | |
| 5,483,863 | A * | 1/1996 | Dreizin | 89/8 |
| 2005/0155487 | A1 * | 7/2005 | Frasca | 89/8 |

* cited by examiner

*Primary Examiner*—Troy Chambers

(74) *Attorney, Agent, or Firm*—Thomas J. Finn; John E. Gunther; Karl A. Vick

(57) ABSTRACT

An electromagnetic coil gun system includes a launcher having a barrel with a longitudinal bore therethrough, and a plurality of longitudinally extending electrical excitation coils arranged circumferentially around the bore of the barrel so that a magnetic field produced by an electrical current in each electrical excitation coil penetrates into the bore. Each electrical excitation coil is independently activated by the electrical current passed therethrough. There is a projectile sized to be received within the bore of the barrel and having a circumferential armature at a tail end thereof, and a nose end. The projectile placed into the bore is fired by producing a traveling sequence of propulsive currents in the electrical excitation coils moving in a direction from the breech end toward the muzzle end of the barrel, so that a traveling propulsive magnetic field produced by the electrical excitation coils interacts with the armature of the projectile to propel the projectile in the direction from the breech end toward the muzzle end of the barrel. Simultaneously, a traveling sequence of field-nulling currents in the electrical excitation coils moves in the direction from the breech end toward the muzzle end of the barrel but closer to the muzzle end of the barrel than the traveling sequence of propulsive currents and spatially leading the traveling sequence of propulsive currents. The field-nulling currents are in a circumferential direction opposite to the propulsive currents, thereby at least partially nulling the traveling propulsive magnetic field at the nose end of the projectile.

17 Claims, 4 Drawing Sheets

MAGNETIC FIELD PROTECTION FOR THE PROJECTILE OF AN ELECTROMAGNETIC COIL GUN SYSTEM

This invention relates to an electromagnetic coil gun system, and more particularly to such a system wherein the projectile has magnetic-field sensitive electronics therein.

BACKGROUND OF THE INVENTION

An electromagnetic coil gun system includes a launcher and a projectile that is fired from the launcher. The launcher has a barrel with a series of circumferential electrical excitation coils that extend longitudinally along the length of the barrel. The projectile has a circumferential armature near its tail. The projectile is propelled from the gun by producing a traveling sequence of propulsive currents in the electrical excitation coils. A propulsive magnetic field produced by the electrical excitation coils interacts with the armature of the projectile to propel the projectile along the length of the barrel and out of the muzzle end of the barrel. The fundamental principles of the electromagnetic coil gun have been known for some time, see for example U.S. Pat. Nos. 2,235,201; 3,611,783; 4,926,741; and 5,125,321, whose disclosures are incorporated by reference in their entireties.

This basic approach under development is promising in those cases where the projectile is an unguided device that is an inert kinetic slug or that contains essentially no more than a warhead. However, it is expected that with further development the range of the electromagnetic coil gun system will be well beyond the line of sight from the launcher. Optimum performance will be achieved by including a guidance subsystem that guides the projectile after it is fired from the launcher.

The guidance subsystem for the projectile of the electromagnetic coil gun system may be based on any operable type of sensing technology. The guidance may be based on radar, visible light, infrared light, the global positioning system (GPS), or any other approach that survives the high acceleration experienced during the launching of the projectile and provides the necessary guidance commands to a control subsystem. These guidance technologies are all susceptible to erratic behavior or failure as a result of the high-magnetic-field environment, typically 30 Teslas or greater, produced within the launcher barrel during the firing of the projectile. Therefore, care must be taken to protect the sensors, signal processors, and other components of the guidance subsystem from the high magnetic fields produced by the launcher.

One approach to protecting the guidance subsystem is to place magnetic shielding around the guidance subsystem. This approach has the drawback that a sufficient amount of magnetic shielding for the extremely high magnetic fields produced by the launcher must be quite thick and consequently heavy. This weight and volume of magnetic shielding adds kinetic mass to the projectile, but it reduces the size of the warhead that may be used.

There is therefore a need for an improved approach to the design of an electromagnetic coil gun system to reduce the adverse effects of the high magnetic fields required to propel the projectile. The present invention fulfills this need, and further provides related advantages.

SUMMARY OF THE INVENTION

The present invention provides an electromagnetic coil gun system and method for its use in firing a projectile. This approach is particularly useful where the projectile includes a guidance subsystem or other components that are sensitive to the high magnetic fields produced by the launcher when the projectile is fired. One embodiment of the present approach uses the available structure of the launcher to reduce the magnitude of the magnetic field experienced in the nose portion of the projectile, where the guidance subsystem is located, while also reducing the amount of shielding required in the nose portion of the projectile.

In accordance with the invention, a method for operating an electromagnetic coil gun system comprises providing an electromagnetic coil gun system including a launcher with a barrel having a longitudinal bore therethrough. The barrel has a breech end and a muzzle end. The barrel also has a plurality of longitudinally extending electrical excitation coils arranged circumferentially around the bore of the barrel so that a magnetic field produced by an electrical current in each electrical excitation coil penetrates into the bore. Each electrical excitation coil is independently activated by the electrical current passed therethrough. The electromagnetic coil gun system further includes a projectile sized to be received within the bore of the barrel. The projectile comprises a circumferential armature at a tail end thereof, and a nose end. The projectile preferably has a guidance subsystem in the nose thereof, with electronic components whose operation may be inhibited or prevented by high magnetic fields.

The projectile is loaded into the bore with the tail end of the projectile adjacent to the breech end of the barrel. A small amount of chemical propellant may be used to initiate the movement of the projectile. The projectile is then fired from the barrel by the steps of producing a traveling sequence of propulsive currents in the electrical excitation coils moving in a direction from the breech end toward the muzzle end of the barrel. A traveling propulsive magnetic field produced by the electrical excitation coils interacts with the armature of the projectile to propel the projectile in the direction from the breech end toward the muzzle end of the barrel.

Simultaneously, a traveling nulling magnetic field is produced to at least partially nullify the traveling propulsive magnetic field at the nose end of the projectile. Preferably, the traveling nulling magnetic field is produced using a traveling sequence of field-nulling currents in the electrical excitation coils moving in the same direction from the breech end toward the muzzle end of the barrel, but closer to the muzzle end of the barrel than the traveling sequence of propulsive currents and spatially leading the traveling sequence of propulsive currents. The field-nulling currents are in a circumferential direction opposite to the propulsive currents, thereby at least partially nulling the traveling propulsive magnetic field at the nose end of the projectile.

The nulling magnetic field may be produced in any operable way. In one embodiment, a maximum field-nulling current is smaller in magnitude than a maximum propulsive current, for example less than about 10 percent of a maximum propulsive current. In another embodiment, a maximum field-nulling current may instead be shorter in spatial extent than a maximum propulsive current. In both of these embodiments, the field-nulling currents are produced in the same electrical excitation coils as are the propulsive currents.

In yet another embodiment, there are two sets of electrical excitation coils, including the propulsive electrical excitation coils and a separate plurality of longitudinally extending nulling electrical excitation coils arranged circumferentially around the bore of the barrel so that a nulling magnetic field produced by a nulling electrical current in each nulling electrical excitation coil penetrates into the bore. Each nulling electrical excitation coil is independently activated by the nulling electrical current passed therethrough. The projectile is fired from the barrel by producing a traveling sequence of propulsive currents in the propulsive electrical excitation coils moving in a direction from the breech end toward the muzzle end of the barrel, whereby a traveling propulsive magnetic field produced by the propulsive electrical excitation coils interacts with the armature of the projectile to propel the projectile in the direction from the breech end toward the muzzle end of the barrel. Simultaneously, a traveling sequence of field-nulling currents is produced in the separate nulling electrical excitation coils moving in the direction from the breech end toward the muzzle end of the barrel but closer to the muzzle end of the barrel than the traveling sequence of propulsive currents and leading the traveling sequence of propulsive currents. The field-nulling currents are in a circumferential direction opposite to the propulsive currents, thereby at least partially nulling the traveling propulsive magnetic field at the nose end of the projectile. (In the earlier-described embodiments, the propulsive electrical excitation coils and the nulling electrical excitation coils are the same electrical excitation coils.)

The timing of the traveling sequence of propulsive currents and the traveling sequence of field-nulling currents is preferably controlled responsive to a measurement of the longitudinal position of the projectile in the barrel. The longitudinal position is preferably measured by a laser rangefinder aimed along the bore of the barrel. The longitudinal position may instead be measured by a series of electric eyes positioned along the length of the barrel, or by any other operable technique.

The present approach at least partially nullifies the traveling propulsive magnetic field in the region of the nose of the projectile, where the guidance subsystem and other magnetic-field-sensitive components are located. However, the nulling magnetic field also negates the traveling propulsive magnetic field to some extent, thereby reducing the propulsive force applied when the projectile is fired. The greater the magnitude of the nulling magnetic field, the more the propulsive force is reduced. Consequently, it is preferred that the magnitude of the nulling magnetic field not be so large as to completely cancel the traveling propulsive magnetic field near the nose of the projectile. Instead, the traveling propulsive magnetic field near the nose of the missile is partially canceled, and a small amount of conventional magnetic shielding is used to protect the guidance subsystem and other sensitive components from the residual magnetic field near the nose of the projectile. Because there is no armature in the projectile near the nose end of the projectile, the adverse effect of the nulling magnetic field in reducing the projectile force and velocity is minimal.

In the preferred embodiment of the present approach, the same electrical excitation coils that produce the traveling propulsive magnetic field also produce the traveling nulling magnetic field. This allows the efficient use of the launcher structure, which is utilized in each firing of a projectile. Additional capacitors and electrical circuitry are required for the launcher to generate the field-nulling currents, but these are a permanent part of the launcher structure and are not consumables. The projectile is modified by reducing the magnetic shielding that is required, allowing the payload to have more weight and volume than would otherwise be the case.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
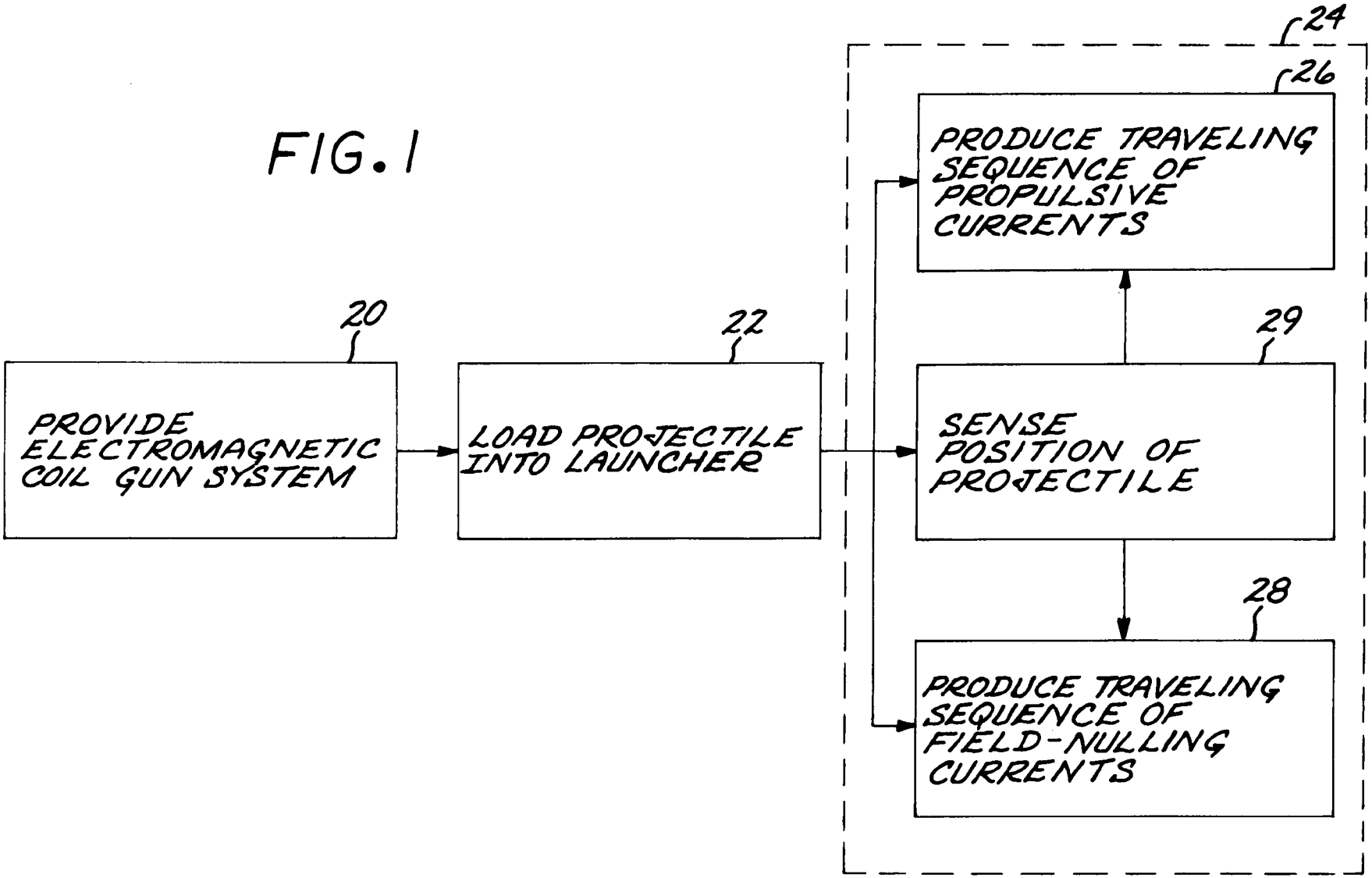
FIG. 1 is a block flow diagram of an embodiment of a method for operating an electromagnetic coil gun system.
Figure 2:
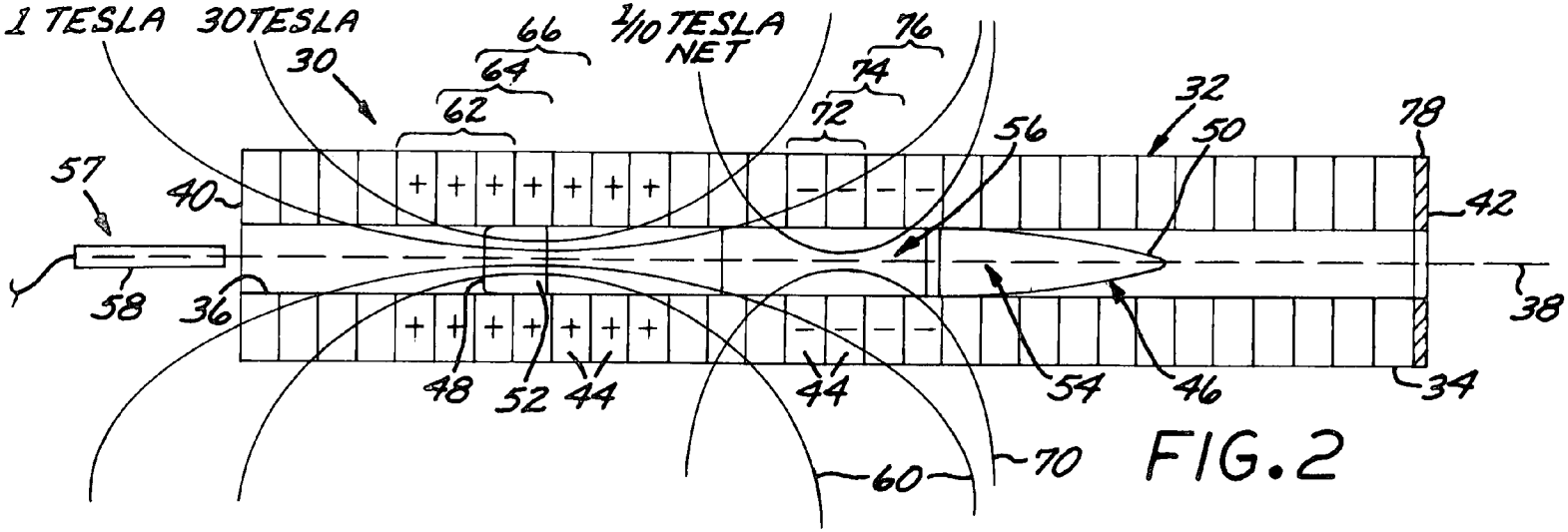
FIG. 2 is a schematic sectional view of a first embodiment of an electromagnetic coil gun system with field-nulling capability.

FIG. 1 depicts an embodiment of a method for operating an electromagnetic coil gun system, and FIG. 2 schematically illustrates an electromagnetic coil gun system 30. The electromagnetic coil gun system 30 is provided, step 20. The electromagnetic coil gun system 30 includes a launcher 32, which includes a barrel 34 having a longitudinal bore 36 therethrough. The barrel 34 and bore 36 are generally cylindrically symmetrical about a centerline 38. (The longitudinal direction is parallel to the centerline 38.) The barrel 34 may be described as having a breech end 40 and a muzzle end 42. The launcher 32 further includes a plurality of longitudinally extending electrical excitation coils 44 arranged circumferentially around the bore 36 of the barrel 34. A magnetic field produced by an electrical current flowing in each electrical excitation coil 44 penetrates into the bore 36. Each electrical excitation coil 44 is independently activated by the electrical current passed therethrough, will be discussed subsequently in relation to FIG. 4. The electrical excitation coils 44 are not a single spirally wound coil extending along the length of the barrel 34, but instead are a large number of individual circumferential coils lying parallel to each other along the length of the barrel 34.

The electromagnetic coil gun system 30 further includes a projectile 46 sized to be received within the bore 36 of the barrel 34. The projectile 46 has a tail end 48 and a nose end 50. A circumferential armature 52 extends around the interior of the projectile 46 near the tail end 48. The armature 52 is typically a ring of electrical conductors such as copper. The projectile further preferably includes a guidance subsystem 54 near the nose end 50. The guidance subsystem 54 includes a sensor of any operable type, such as a radar sensor, a visible-light sensor, an infrared-light sensor, a global positioning system (GPS) sensor, or any other type of sensor that survives the high acceleration experienced during the launching of the projectile 46 and provides the necessary guidance commands to a control subsystem (not shown) that typically includes controllable fins that are behind or are stored within the body of the projectile 46 during firing and then open after firing. Other operable guidance techniques for the guidance subsystem 54 may also be used, such as reaction jets, small explosive charges, and the like. A payload 56, typically an explosive warhead, occupies the interior of the body of the projectile 46 aft of the guidance subsystem 54 and forward of the armature 52.

The projectile 46 is loaded into the bore 36 of the barrel 34 of the launcher 32 with the tail end 48 of the projectile 46 adjacent to the breech end 40 of the barrel 34, step 22.

The launcher 32 preferably includes a projectile position sensor 57 for determining the longitudinal location of the projectile 46 along the length of the barrel 34. In the preferred approach, a laser rangefinder 58 is positioned at the breech end 40 of the barrel 34 with its laser output aimed down the bore 36 from the breech end 40 toward the muzzle end 42, to sense the position of the tail end 48 of the projectile 46.

The projectile 46 is fired, step 24, from the barrel 34 by simultaneous operations. After movement of the projectile 46 is initiated, typically by a small explosive charge, a traveling sequence of propulsive currents is produced in the electrical excitation coils 44 moving in a direction from the breech end 40 toward the muzzle end 42 of the barrel 34, step 26. The result is that a traveling propulsive magnetic field produced by the electrical excitation coils 44 interacts with the armature 52 of the projectile 46 to propel the projectile 46 in the direction from the breech end 40 toward the muzzle end 42 of the barrel 34, and thence on a flight path out of the barrel 34.

Simultaneously with step 26, a traveling nulling magnetic field is produced, step 28, to at least partially nullify the traveling propulsive magnetic field at the nose end 50 of the projectile 46. Preferably and as illustrated in FIG. 2, the traveling nulling magnetic field is a traveling sequence of field-nulling currents in the electrical excitation coils 44 moving in the direction from the breech end 40 toward the muzzle end 42 of the barrel 34, but closer to the muzzle end 42 of the barrel 34 than the traveling sequence of propulsive currents and spatially leading the traveling sequence of propulsive currents. In this preferred embodiment, the field-nulling currents are in a circumferential direction opposite to the propulsive currents, thereby at least partially nulling the traveling propulsive magnetic field at the nose end 50 of the projectile 46.

Simultaneously with steps 26 and 28, the position of the projectile 46 within the barrel 34 is sensed and measured, step 29, by the projectile position sensor 57. The sensed position of the projectile 46 is used to time the traveling sequence of propulsive currents in step 26 and the traveling sequence of field-nulling currents in step 28.

Figure 3:
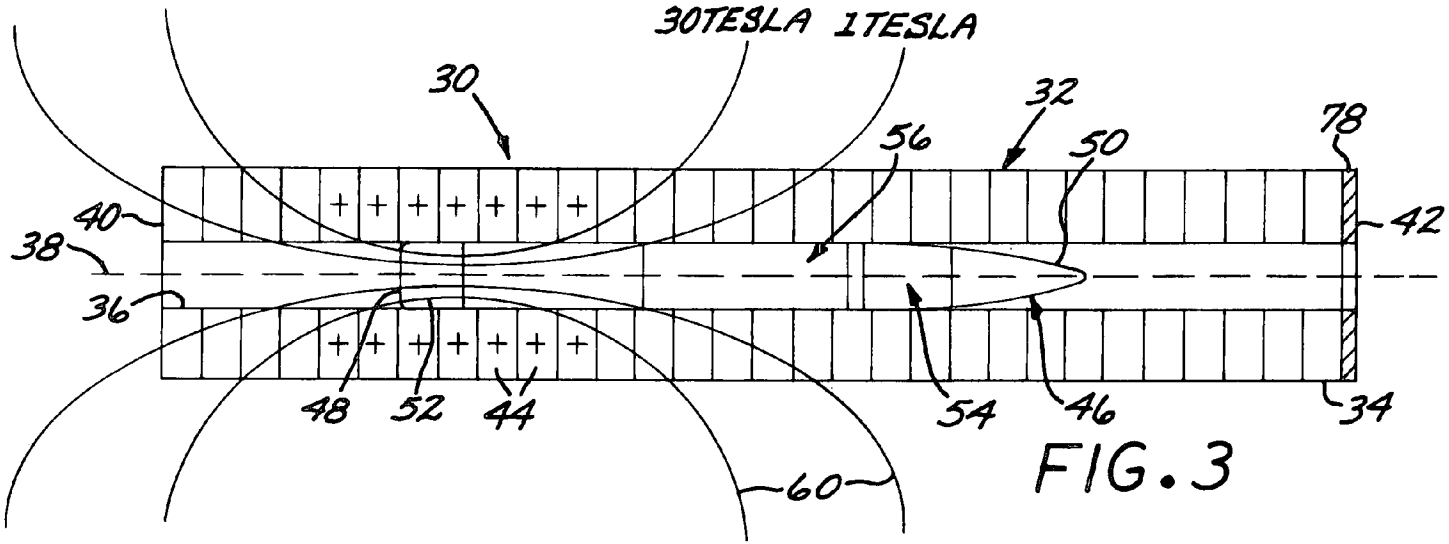
FIG. 3 is a schematic sectional view of an electromagnetic coil gun system without field-nulling capability.

FIGS. 2–3 illustrate the traveling propulsive magnetic field 60 that is formed by passing electrical currents through a first group 62 of the electrical excitation coils 44. The propulsive magnetic field 60 interacts with the armature 52 of the projectile 46. The traveling propulsive magnetic field 60 sweeps to the right in the view of FIGS. 2–3, so that the propulsive magnetic field 60 is next produced by a second group 64 of the electrical excitation coils 44, then a third group 66 of the electrical excitation coils 44, and so on. This progressive movement of the propulsive magnetic field 60 drives the projectile 46 to the right in the view of FIGS. 2–3.

To reduce the magnitude of the magnetic field 60 at the nose end 50, the traveling nulling magnetic field 70 is produced simultaneously with the propulsive magnetic field 60. FIG. 2 illustrates the traveling nulling magnetic field 60 that is formed by passing electrical currents through a fourth group 72 of the electrical excitation coils 44 that are spaced to the right (that is, leading the armature 52 of the projectile 46 and nearer the muzzle end 42 of the barrel 34), at the same time the propulsive magnetic field 60 is being produced by the first group 62 of electrical excitation coils 44. The nulling magnetic field 70 is opposite in sign to the propulsive magnetic field 60, because the nulling electrical current that produces the nulling magnetic field 70 is passed through the fourth group 72 of the electrical excitation coils 44 in the circumferential direction opposite to that in which the propulsive electrical current is passed through the first group 62 of the electrical excitation coils 44. The nulling magnetic field 70 at least partially cancels the propulsive magnetic field 60 in the neighborhood of the nose end 50 of the projectile 46. The traveling nulling magnetic field 70 sweeps to the right in the view of FIG. 2 at the same rate as the traveling propulsive magnetic field 60 sweeps to the right. In the example, the nulling magnetic field 70 is later produced by a fifth group 74 of the electrical excitation coils 44 at the same time the propulsive magnetic field 60 is produced in the second group 64 of the electrical excitation coils 44. At a still later time, the nulling magnetic field 70 is produced in a sixth group 76 of the electrical excitation coils 44 at the same time the propulsive magnetic field 60 is produced in the third group 66 of the electrical excitation coils 44, and so on.

In the illustration of FIG. 3, an approach that is not within the scope of the invention, no nulling magnetic field is present. The magnitude of the propulsive magnetic field 60 at the nose end 50 of the projectile 46, and thence in the guidance subsystem 54, is therefore much larger than where the nulling magnetic field is produced as in FIG. 2.

Optionally but desirably, a shield 78 of a paramagnetic material may be positioned over the muzzle end 42 of the barrel 34 to prevent the magnetic fields from projecting beyond the muzzle end 42 of the barrel 34.

Figure 4:
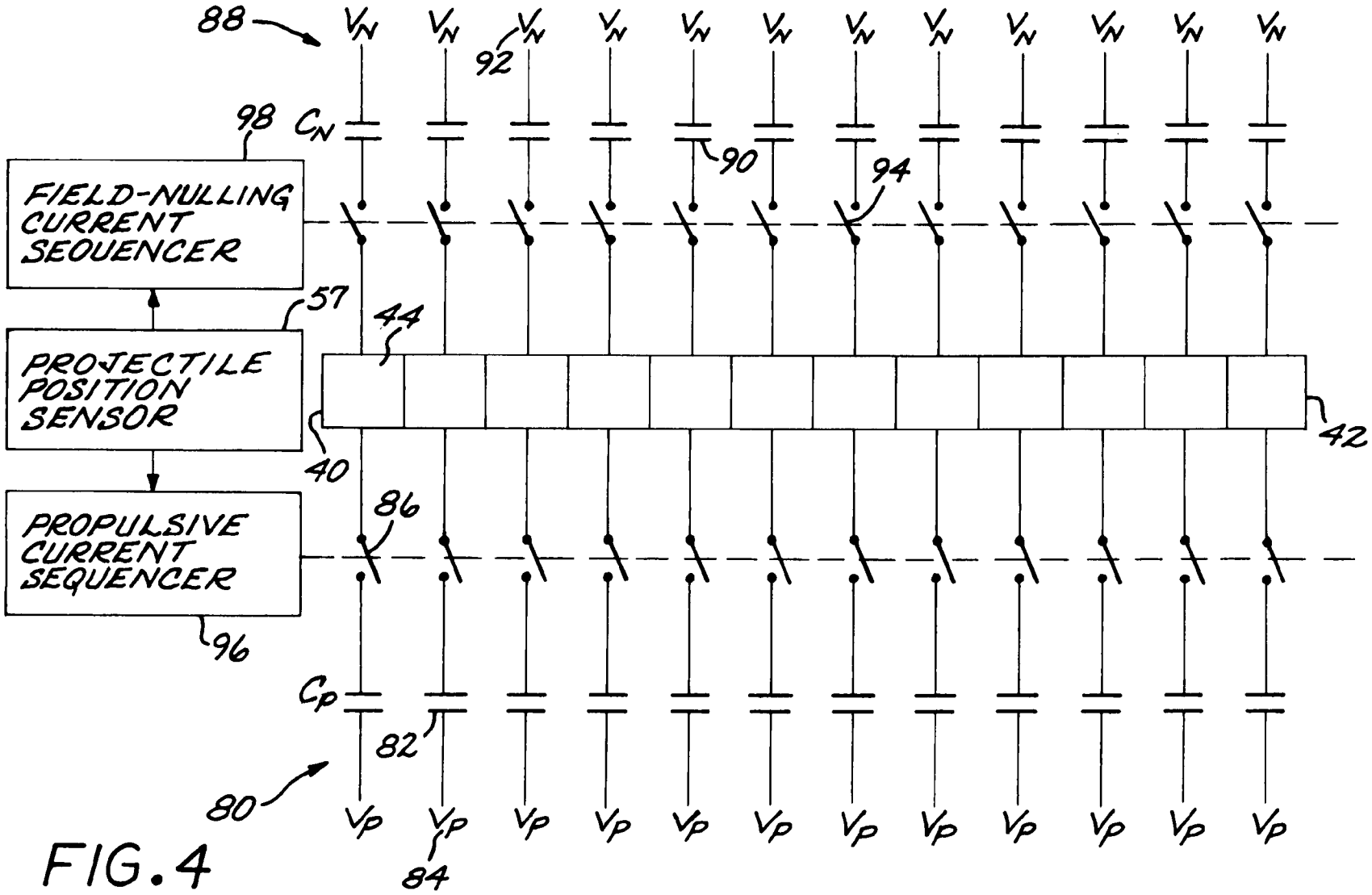
FIG. 4 is a schematic drawing of electrical circuitry for the electromagnetic coil gun system with the first embodiment of field-nulling capability.

FIG. 4 illustrates in a simplified form the electrical circuitry by which the traveling magnetic fields 60 and 70 are produced. In general, each electrical excitation coil 44 is controllably driven by a propulsive current source 80 having a propulsive capacitor 82 charged by a propulsive voltage source 84. The propulsive capacitor 82 is controllably connected to the respective electrical excitation coil 44 by a propulsive switch 86. Similarly, each electrical excitation coil 44 is controllably driven by a nulling current source 88 having a nulling capacitor 90 charged by a nulling voltage source 92. The nulling capacitor 90 is controllably connected to the respective electrical excitation coil 44 by a nulling switch 94. (The electrical excitation coils 44 at the breech end 40 of the barrel 34 may not have nulling current sources 88, and the electrical excitation coils 44 at the muzzle end 42 of the barrel 34 may not have propulsive current sources 80, as these current sources would not come into play in normal operation.) The propulsive switches 86 are sequentially activated by a propulsive current sequencer 96, and the nulling switches 94 are sequentially activated by a field-nulling current sequencer 98, responsive to the position of the projectile as sensed by the position sensor 57, thereby cooperating to produce the respective traveling magnetic fields 60 and 70 discussed above.

Figure 5:
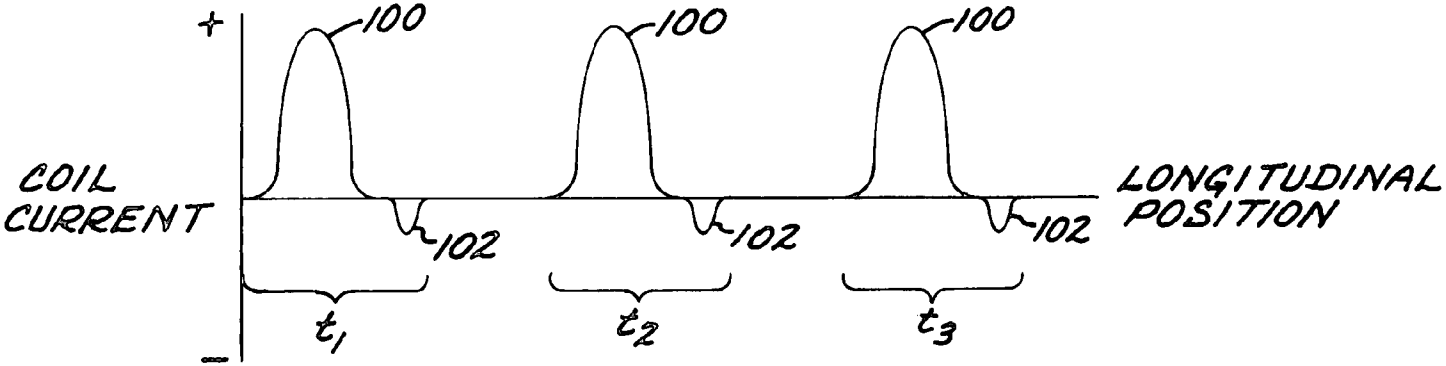
FIG. 5 is a graph of coil current as a function of longitudinal position, showing the propulsive current and the field-nulling current at two different times.

As illustrated in FIG. 5, the larger propulsive current 100 is preceded down the barrel 34 by the smaller field-nulling current 102 in a traveling, wavelike motion. At a time $t_1$, the propulsive current 100 and the field-nulling current 102 are at a first position (to the left, preserving the same orientation of the barrel 34 and the projectile 46 as in FIGS. 2–3). At a later time $t_2$, the propulsive current 100 and the field-nulling current 102 have both moved to the right to a second position, driving the projectile 46 to the right. At a still-later time $t_3$, the propulsive current 100 and the field-nulling current 102 have both moved to the right to a third position, further driving the projectile 46 to the right.

The nulling magnetic field 70 at least partially cancels the propulsive magnetic field 60 in the region of the guidance subsystem 54, reducing the amount of shielding that must be carried within the projectile 46. The nulling magnetic field 70 also reduces the propulsive force slightly, but because the electrical excitation coils 44 that produce the nulling magnetic field 70 are more remote from the armature 52, this propulsion-reduction effect is relatively small.

Additionally, because the propulsive magnetic field 60 is maximal in the electrical excitation coils 46 facing the tail end 48 of the projectile 46 and thence facing the armature 52, the magnitude of the propulsive magnetic field 60 falls substantially, typically by at least 1–2 orders of magnitude, at the nose end 50. Consequently, the nulling magnetic field 70 may be made relatively small. The effect of the nulling magnetic field 70 may be made relatively small by any operable approach. In one approach, a maximum field-nulling current is smaller in magnitude than a maximum propulsive current, typically less than about 10 percent of a maximum propulsive current and preferably less than 3 percent of the maximum propulsive current. In another approach, a maximum field-nulling current is applied for a shorter longitudinal spatial extent along the length of the barrel 34 than a maximum propulsive current. That is, fewer of the electrical excitation coils 44 are driven at any moment for the nulling magnetic field 70 than for the propulsive magnetic field 60. The magnitude of the driving current and the number of electrical excitation coils 44 being driven for the propulsive magnetic field 60 and the nulling magnetic field 70 may be optimized to maximize the propulsive force and minimize the net magnetic field at the guidance subsystem 54 for each type of projectile 46, diameter of the projectile 46, and the like.

Figure 6:
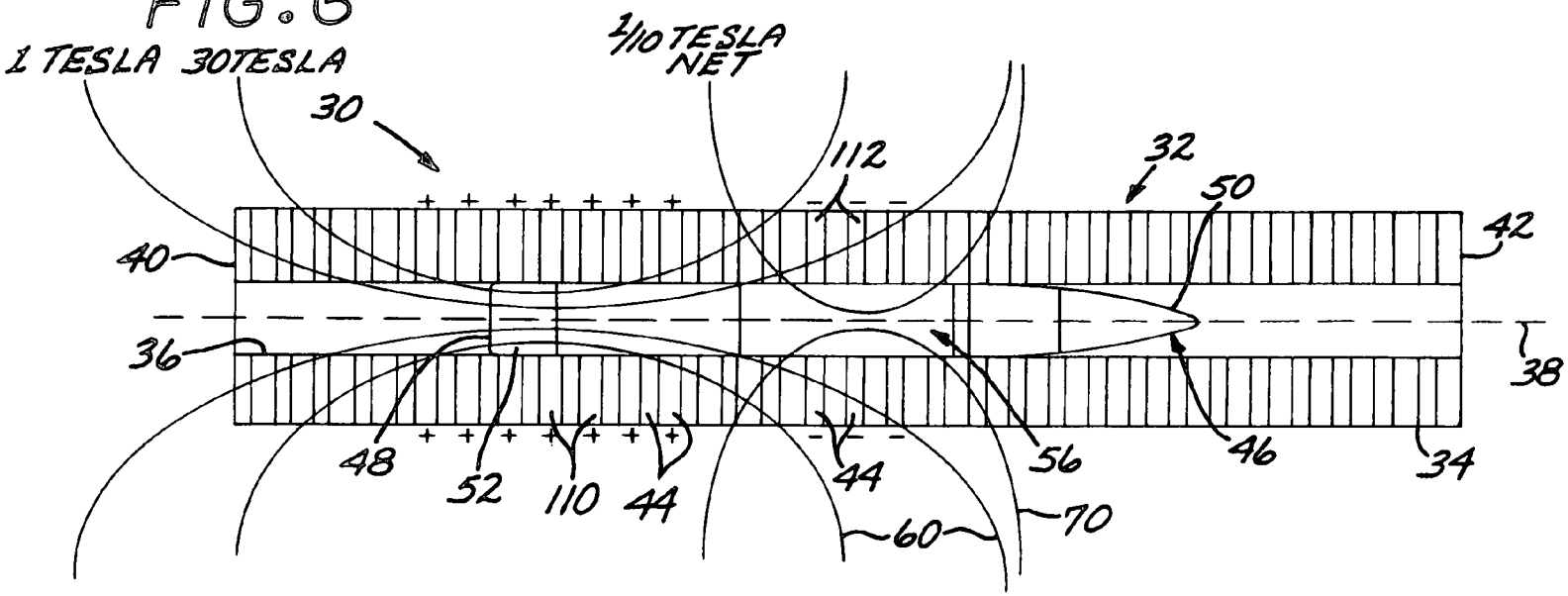
FIG. 6 is a schematic drawing of a second embodiment of an electromagnetic coil gun system with field-nulling capability and using separate sets of propulsive electrical excitation coils and nulling electrical excitation coils.

The embodiment of FIG. 6 is similar to that of FIG. 2, except that there are two different sets of electrical excitation coils, a set of propulsive electrical excitation coils 110 and a set of nulling electrical excitation coils 112. The propulsive magnetic field 60 is produced by passing electrical current through the propulsive electrical excitation coils 110, and the nulling magnetic field 70 is produced by passing electrical current through the nulling electrical excitation coils 112. Otherwise, the functioning of this embodiment is the same as that of FIG. 2, and the prior description is incorporated here. The approach of FIG. 6 offers an additional degree of flexibility in optimizing the positioning and size of the set of propulsive electrical excitation coils 110 and the set of nulling electrical excitation coils 112, at the cost of added construction complexity and limiting the size of the propulsive electrical excitation coils 110.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for operating an electromagnetic coil gun system, comprising the steps of providing an electromagnetic coil gun system including a launcher comprising a barrel having a longitudinal bore therethrough, wherein the barrel has a breech end and a muzzle end, and a plurality of longitudinally extending electrical excitation coils arranged circumferentially around the bore of the barrel so that a magnetic field produced by an electrical current in each electrical excitation coil penetrates into the bore, wherein each electrical excitation coil is independently activated by the electrical current passed therethrough, and a projectile sized to be received within the bore of the barrel, wherein the projectile comprises a circumferential armature at a tail end thereof, and a nose end;

loading the projectile into the bore with the tail end of the projectile adjacent to the breech end of the barrel; and firing the projectile from the barrel by the steps of producing a traveling sequence of propulsive currents in the electrical excitation coils moving in a direction from the breech end toward the muzzle end of the barrel, whereby a traveling propulsive magnetic field produced by the electrical excitation coils interacts with the armature of the projectile to propel the projectile in the direction from the breech end toward the muzzle end of the barrel, and simultaneously producing a traveling nulling magnetic field to at least partially nullify the traveling propulsive magnetic field at the nose end of the projectile.

2. The method of claim 1, wherein the step of producing a traveling nulling magnetic field includes the step of producing a traveling sequence of field-nulling currents in a circumferential direction opposite to the propulsive currents.

3. The method of claim 1, wherein the step of providing the electromagnetic coil gun system includes the step of providing the projectile having a guidance subsystem in the nose thereof.

4. The method of claim 1, wherein the step of providing the electromagnetic coil gun system includes the step of providing the projectile having a guidance subsystem in the nose thereof and magnetic shielding for the guidance subsystem.

5. A method for operating an electromagnetic coil gun system, comprising the steps of providing an electromagnetic coil gun system including a launcher comprising a barrel having a longitudinal bore therethrough, wherein the barrel has a breech end and a muzzle end, and a plurality of longitudinally extending propulsive electrical excitation coils arranged circumferentially around the bore of the barrel so that a traveling propulsive magnetic field produced by a propulsive electrical current in each propulsive electrical excitation coil penetrates into the bore, wherein each propulsive electrical excitation coil is independently activated by the propulsive electrical current passed therethrough, a plurality of longitudinally extending nulling electrical excitation coils arranged circumferentially around the bore of the barrel so that a nulling magnetic field produced by a nulling electrical current in each nulling electrical excitation coil penetrates into the bore, wherein each nulling electrical excitation coil is independently activated by the nulling electrical current passed therethrough, and a projectile sized to be received within the bore of the barrel, wherein the projectile comprises a circumferential armature at a tail end thereof, and a nose end;

loading the projectile into the bore with the tail end of the projectile adjacent to the breech end of the barrel; and firing the projectile from the barrel by the steps of producing a traveling sequence of propulsive currents in the propulsive electrical excitation coils moving in a direction from the breech end toward the muzzle end of the barrel, whereby a traveling propulsive magnetic field produced by the propulsive electrical excitation coils interacts with the armature of the projectile to propel the projectile in the direction from the breech end toward the muzzle end of the barrel, and simultaneously producing a traveling sequence of field-nulling currents in the nulling electrical excitation coils moving in the direction from the breech end toward the muzzle end of the barrel but closer to the muzzle end of the barrel than the traveling sequence of propulsive currents and leading the traveling sequence of propulsive currents, wherein the field-nulling currents are in a circumferential direction opposite to the propulsive currents, thereby at least partially nulling the traveling propulsive magnetic field at the nose end of the projectile.

6. The method of claim 5, wherein the step of producing a traveling sequence of field-nulling currents includes the step of producing the traveling sequence of field-nulling currents, wherein a maximum field-nulling current is smaller in magnitude than a maximum propulsive current.

7. The method of claim 5, wherein the step of producing a traveling sequence of field-nulling currents includes the step of producing the traveling sequence of field-nulling currents, wherein a maximum field-nulling current is less than about 10 percent of a maximum propulsive current.

8. The method of claim 5, wherein the step of producing a traveling sequence of field-nulling currents includes the step of producing the traveling sequence of field-nulling currents, wherein a maximum field-nulling current is shorter in spatial extent than a maximum propulsive current.

9. The method of claim 5, wherein the step of providing the electromagnetic coil gun system includes the step of providing the projectile having a guidance subsystem in the nose thereof.

10. The method of claim 5, wherein the step of providing the electromagnetic coil gun system includes the step of providing the projectile having a guidance subsystem in the nose thereof and magnetic shielding for the guidance subsystem.

11. The method of claim 5, wherein the step of providing an electromagnetic coil gun system includes the step of providing the propulsive electrical excitation coils and the nulling electrical excitation coils as the same electrical excitation coils.

12. A method for operating an electromagnetic coil gun system, comprising the steps of providing an electromagnetic coil gun system including a launcher comprising a barrel having a longitudinal bore therethrough, wherein the barrel has a breech end and a muzzle end, and a plurality of longitudinally extending electrical excitation coils arranged circumferentially around the bore of the barrel so that a magnetic field produced by an electrical current in each electrical excitation coil penetrates into the bore, wherein each electrical excitation coil is independently activated by the electrical current passed therethrough, and a projectile sized to be received within the bore of the barrel, wherein the projectile comprises a circumferential armature at a tail end thereof, and a nose end;

loading the projectile into the bore with the tail end of the projectile adjacent to the breech end of the barrel; and firing the projectile from the barrel by the steps of producing a traveling sequence of propulsive currents in the electrical excitation coils moving in a direction from the breech end toward the muzzle end of the barrel, whereby a traveling propulsive magnetic field produced by the electrical excitation coils interacts with the armature of the projectile to propel the projectile in the direction from the breech end toward the muzzle end of the barrel, and simultaneously producing a traveling sequence of field-nulling currents in the electrical excitation coils moving in the direction from the breech end toward the muzzle end of the barrel but closer to the muzzle end of the barrel than the traveling sequence of propulsive currents and leading the traveling sequence of propulsive currents, wherein the field-nulling currents are in a circumferential direction opposite to the propulsive currents, thereby at least partially nulling the traveling propulsive magnetic field at the nose end of the projectile.

13. The method of claim 12, wherein the step of producing a traveling sequence of field-nulling currents includes the step of producing the traveling sequence of field-nulling currents, wherein a maximum field-nulling current is smaller in magnitude than a maximum propulsive current.

14. The method of claim 12, wherein the step of producing a traveling sequence of field-nulling currents includes the step of producing the traveling sequence of field-nulling currents, wherein a maximum field-nulling current is less than about 10 percent of a maximum propulsive current.

15. The method of claim 12, wherein the step of producing a traveling sequence of field-nulling currents includes the step of producing the traveling sequence of field-nulling currents, wherein a maximum field-nulling current is shorter in spatial extent than a maximum propulsive current.

16. The method of claim 12, wherein the step of providing the electromagnetic coil gun system includes the step of providing the projectile having a guidance subsystem in the nose thereof.

17. The method of claim 12, wherein the step of providing the electromagnetic coil gun system includes the step of providing the projectile having a guidance subsystem in the nose thereof and magnetic shielding for the guidance subsystem.

* * * * *